United States Patent [19]

Lacoste

[11] Patent Number: 4,913,779

[45] Date of Patent: Apr. 3, 1990

[54] PROCESS AND INSTALLATION FOR ELECTROLYSIS BY PERCOLATION ACROSS ONE OR SEVERAL POROUS VOLUMIC ELECTRODES

[75] Inventor: Germain Lacoste, Tournefeuille, France

[73] Assignee: Institut National Polytechnique de Toulouse, Toulouse, France

[21] Appl. No.: 297,858

[22] PCT Filed: Jun. 2, 1987

[86] PCT No.: PCT/FR87/00192

§ 371 Date: Dec. 2, 1988

§ 102(e) Date: Dec. 2, 1988

[87] PCT Pub. No.: WO87/07653

PCT Pub. Date: Dec. 17, 1987

[30] Foreign Application Priority Data

Jun. 6, 1986 [FR] France ..... 86 08331

[51] Int. Cl.[4] ..... B01D 59/40; C25C 1/00; C25C 7/00

[52] U.S. Cl. ..... 204/1.11; 204/105 R; 204/222; 204/273; 204/284

[58] Field of Search ..... 204/1 R, 105 R, 222, 204/273, 284

[56] References Cited

U.S. PATENT DOCUMENTS 3,966,571 6/1976 Gagnon et al. ..... 204/149

*Primary Examiner*—T. Tung
*Assistant Examiner*—David G. Ryser
*Attorney, Agent, or Firm*—Harold H. Dutton, Jr.

[57] ABSTRACT

The invention relates to a process and an apparatus for electrolysis by percolation through at least one porous volumic electrode, for carrying out an electrochemical reaction. The process is of the type comprising electrically polarizing each volumic electrode formed by a conductive bed of solid particles (2), and causing a liquid electrolyte to circulate through said volumic electrode. The process according to the invention is characterized in causing a periodic pulsation of the electrolyte, such that the particles of the bed forming the volumic electrode are placed in a state of fluidization during one fraction of the cycle of pulsation and remain in a fixed bed during the remainder of the cycle with reversal of the direction of circulation. The process suppresses the phenomena of clogging while providing an excellent coefficient of transfer, without disturbing the selectivity of the electrochemical reaction.

11 Claims, 5 Drawing Sheets

$\frac{\bar{I}_P}{I_0}$
3
2
1
0
1
4
10
20
30
38
40
46
50
$\frac{2\pi af}{V_0}$
A
B
Z

PROCESS AND INSTALLATION FOR ELECTROLYSIS BY PERCOLATION ACROSS ONE OR SEVERAL POROUS VOLUMIC ELECTRODES

The invention relates to a process and an installation for electrolysis by percolation across one or several porous volumic electrodes, in order to achieve an electrochemical reaction. The invention applies in particular to the recovery of metals from dilute ionic solutions.

The carrying out of electrochemical reactions by electrolysis of a circulating solution across a conductive bed of solid particles, polarized negatively or positively according to the desired reaction, has been known for some time. This bed forms an electrode generally termed a "porous volumic electrode," which offers high specific surfaces and permits in particular the treatment of dilute ionic solutions, subjected to low current densities. One could refer, for example, to the following prior document which describes examples of such electrolyses: French patent No. 80.07039.

The fundamental deficiency of this type of electrolysis resides in the rapid plugging or clogging of the bed of particles forming each porous volumic electrode. This clogging causes, first, the appearance of preferential passages with different circulation speeds which disturb the activity, then rapidly block the operation. In the case of a reduction reaction (for example the recovery of metals), this clogging results from the appearance of solid bridges which are formed in the pores between particles.

This deficiency is accentuated on the periphery of the bed, in the vicinity of one or several polarized counter electrodes, at the sites where the activity is the most intense. When a separation membrane is provided, it may be impregnated with micro-crystals and be inflated to the point of rupture.

It should be noted that electrolyses of this type have been carried out across beds of particles placed into movement, periodically, in order to suppress the phenomenon of clogging. However, the electrical conductivity at the center of the bed is then carried out under very poor conditions and much lower electrolysis current densities that in a fixed bed, leading to mass transfers which are very insufficient for making the process applicable on an industrial scale.

For example, French patent No. 2,020,055 describes a process consisting of confining the bed of particles between two grills and mentions that it is possible to assure a fluidization by impulses in order to bond the bed in the upper part with a high circulation speed and to leave it fixed in the lower part at a lower speed. U. S. Pat. No. 3,966,571 describes an analagous process in which the bed of particles is only polarized in the top part, the displacement toward the lower part serving to unclog the bed. However, the material transfers are very mediocre and remain quite inferior in this type of process to those of an equivalent fixed bed. Thus, an unclogging of the bed is achieved, but only at the expense of a notable decline in efficiency.

The present invention proposes to provide a solution to the problem set forth above of the clogging of porous volumic electrodes.

The essential object of the invention is to suppress the phenomena of clogging, while considerably improving the mass transfer.

Another object is to obtain the effects described above without disturbing the selectivity of the reaction viv-a-vis the deposited specie.

To this effect, the electrolysis process according to the invention comprises electrically polarizing each volumic electrode, formed by a conductive bed of solid particles, causing to circulate through said volumic electrode a liquid electrolyte at an average flow speed Vo, and causing a pulsation of the electrolyte circulating through the volumic electrode. The process according to the invention is characterized in that a periodic pulsation is superposed on the circulation of the electrolyte, the pulsation having an amplitude -a- and a frequency -f- satisfying the following conditions:

in the case of an ascending or upward circulation:

$$a \cdot f > \frac{|Vmf - Vo|}{2\pi} \text{ and } a \cdot f > 4\frac{Vo}{2\pi}$$

in the case of a descending or downward circulation:

$$a \cdot f > \frac{Vmf + Vo}{2\pi} \text{ and } a \cdot f > 4\frac{Vo}{2\pi}$$

in which Vo, a and f are the respective arithmetic values of the flowing velocity, the amplitude and the frequency, and Vmf is the arithmetic value of the minimum fluidization velocity of the bed of particles.

These conditions lead to the following operation:

during one fraction of the cycle, the particles of the bed forming the volumic electrode are found in a lower position in a fixed bed with an instantaneous speed resulting from the electrolyte changing direction in the course of this fraction of the cycle in giving rise to an outflow in the agitated, turbulent, normal operation, and, during the other remaining fraction of the cycle, called the moment of fluidization, the particles are placed in a state of fluidization.

Thus, the periodic fluidization of each volumic electrode suppresses the clogging phenomena, while separating and dislocating the particles which can no longer unite themselves, while the operation in a fixed bed during the rest of the cycle with inversion of the speed of flow of the electrolyte enables an electric conductivity under satisfactory conditions at the interior of the electrode.

Experiments have shown that this inversion of speed at the center of the lower fixed bed was essential to obtain good mass transfer and give rise to a significant and unexpected improvement with respect to a continuous outflow without change of direction. These performances have been explained by a change of the normal operation of outflow which creates the inversion of the speed during the course of the effective transfer phase: in the process of the invention, the inversion of speed induces an outflow to the center of the fixed bed of a turbulent, agitated type, while, in the known processes, this outflow is of the laminar type: overall, the normal outflow operation piston which characterizes the outflow in a conventional fixed bed transforms to a continuous agitated operation (C.A.O.) which tends to homogenize the concentration in the bed, and to provide a uniform potential distribution, only slightly dependent on the intensity of the current. This changing of operation explains the sudden displacement of the performances. It should be noted that the increases in the transfer is obtained without disturbing the selectivity of the reaction vis-a-vis the deposited specie.

The flow speed Vo will in practice generally be chosen significantly lower than the minimum fluidization velocity Vmf (Vmf > 10 Vo) in order that the fluidization is only caused by the periodic pulsation superposed on the flow.

There is also interest in avoiding the condition in which the duration of the instants of fluidization are too great with respect to the duration of the other fraction of the cycle (during which the transfers have a high intensity). To this effect, the pulsation superposed on the flow is preferably such that:

in the case of an ascending or upward flow:

$$a \cdot f \leqq \frac{1.2\ Vmf - Vo}{2\pi}$$

in the case of a descending or downward flow:

$$a \cdot f \leqq \frac{1.2\ Vmf + Vo}{2\pi}$$

These conditions impose, in each cycle, a duration of the instant of fluidization which is very slight with respect to the duration of the other fraction of the cycle; one may thus achieve a coefficient of transfer increased on the order of 300% with respect to that of an analagous laminar fixed bed. Moreover, the unclogging, whatever may occur during the short instants, remains efficient, since it is achieved periodically in each cycle.

In the case in which the electrochemical reaction creates a deposit on the particles, they will grow larger little by little without disturbing the operation since the particles are periodically separated during the instants of fluidization. It is understood that the pulsation is then adjusted or regulated in order that the larger particles continue to be fluidized during the short fraction of the pulsation cycle. In the case of non-adherent deposits, those are eliminated continuously in the course of the instants of fluidization such that the electrode benefits from a continuous regeneration.

It should be noted that the process of the invention may be carried out with beds which are low conductors by reason of the suppression of the superficial caking phenomena, arising from permanent homogenization of the bed which causes the bed to work in its entire volume.

The pulsation of the electrolyte may be produced by any appropriate means (piston, pulsing pump . . . ); this pulsation will be produced in practice with a frequency between 0.5 and 2 hertz, this range of frequency appearing to give the best results. The pulsation produced should preferably be approximately sinusoidal, the resulting instantaneous velocity v(t) being given for each cycle by the expression: $v(t) = Vo + 2\pi af \sin 2\pi ft$.

The invention also relates to an electrolysis installation or apparatus for carrying out the previously described process; this installation comprises a reactor provided with an inlet and an outlet for the electrolyte, at least one porous volumic electrode comprising a conductive bed of solid particles disposed in the reactor, at least one conductive counterelectrode arranged in said reactor, electric means connected to each counterelectrode and to each volumic electrode for polarizing the electrodes, means for circulating the electrolyte in the reactor and means for causing a pulsation of the electrolyte at the level of the bed(s) of particles forming the volumic electrode(s). Said installation is characterized in that the means for causing the pulsation comprises an extension mounted on the reactor and provided with a periodic displacement member actuated by driving means.

This installation may be of the axial type (electric field parallel to the flow velocity) or of the crossed type (electric field not parallel to the flow velocity). It may be of the "multi-bed" type comprising several superimposed volumic electrodes and several counterelectrodes associated therewith.

The invention having been thus described in its general form, other characteristics, objects and advantages thereof will become apparent from the description which follows in reference to the accompanying drawings, which show several examples thereof; in these drawings.

Figure 3:
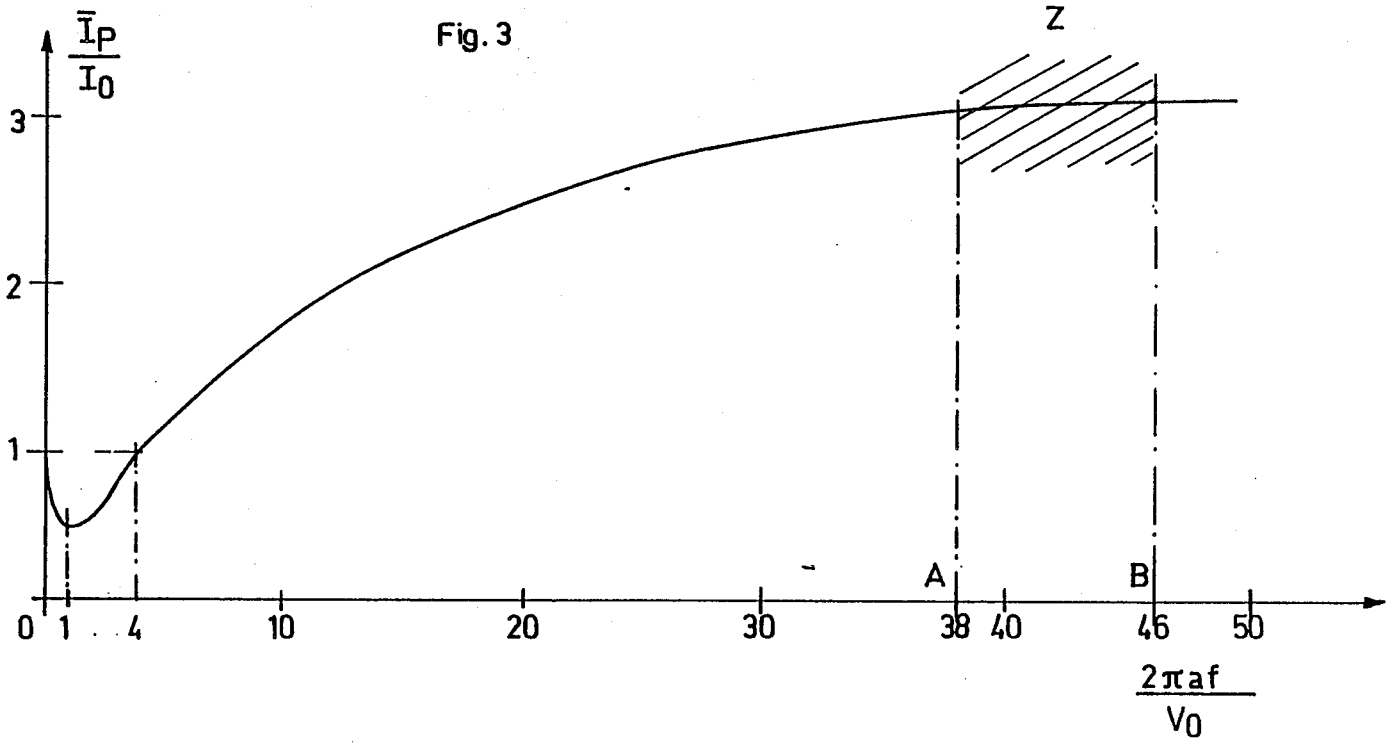
Figure 4:
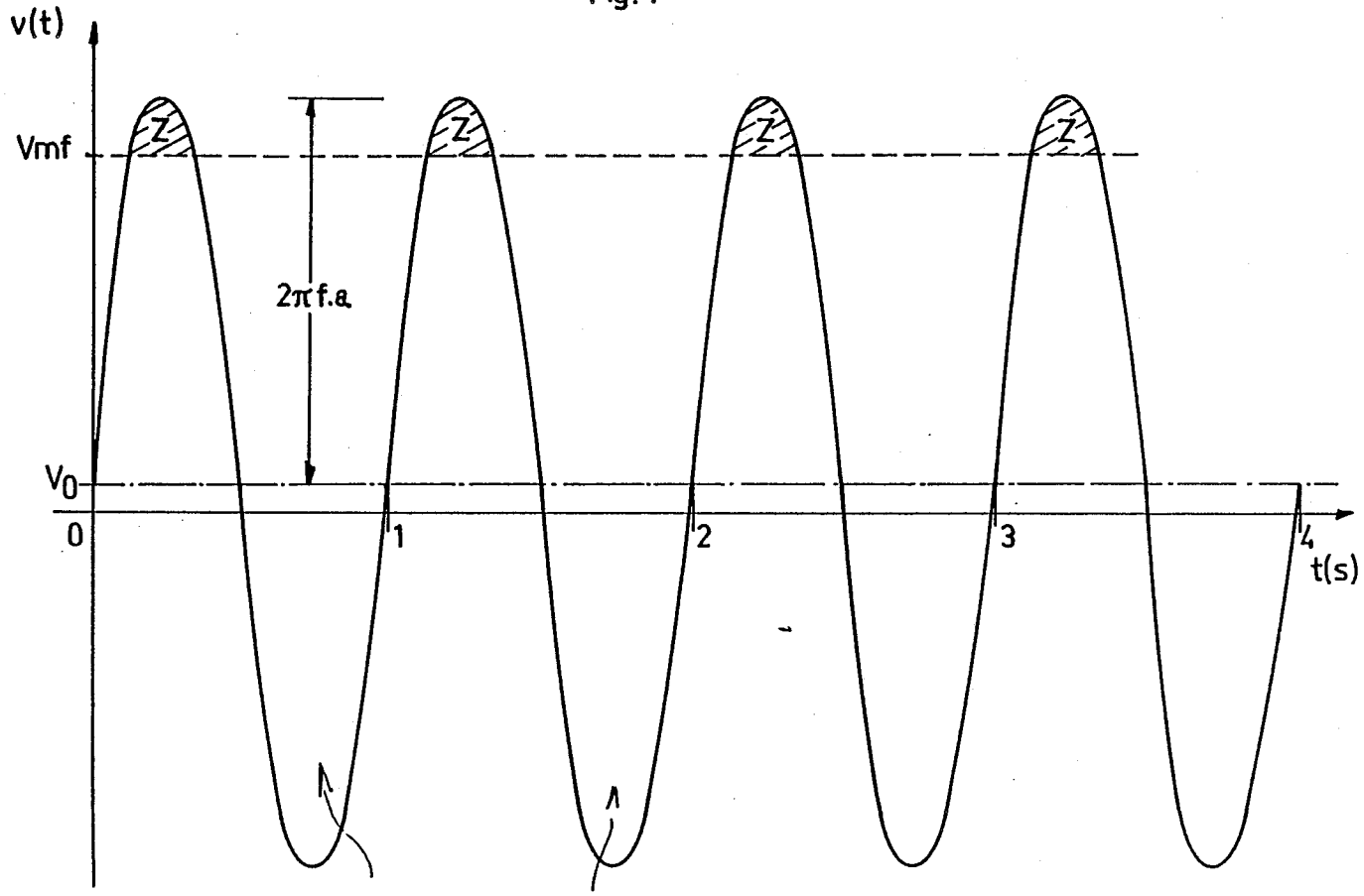
Figure 6:
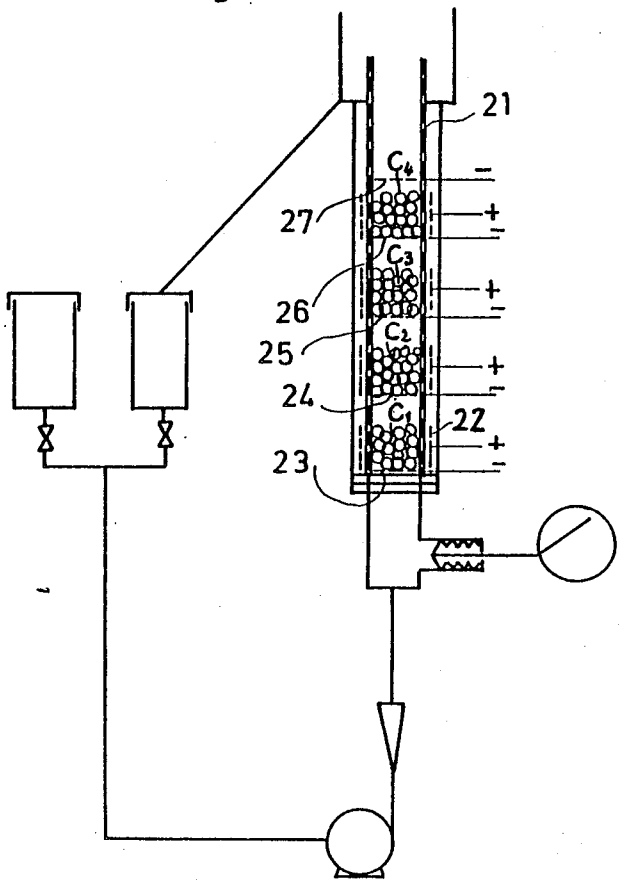
Figure 5:
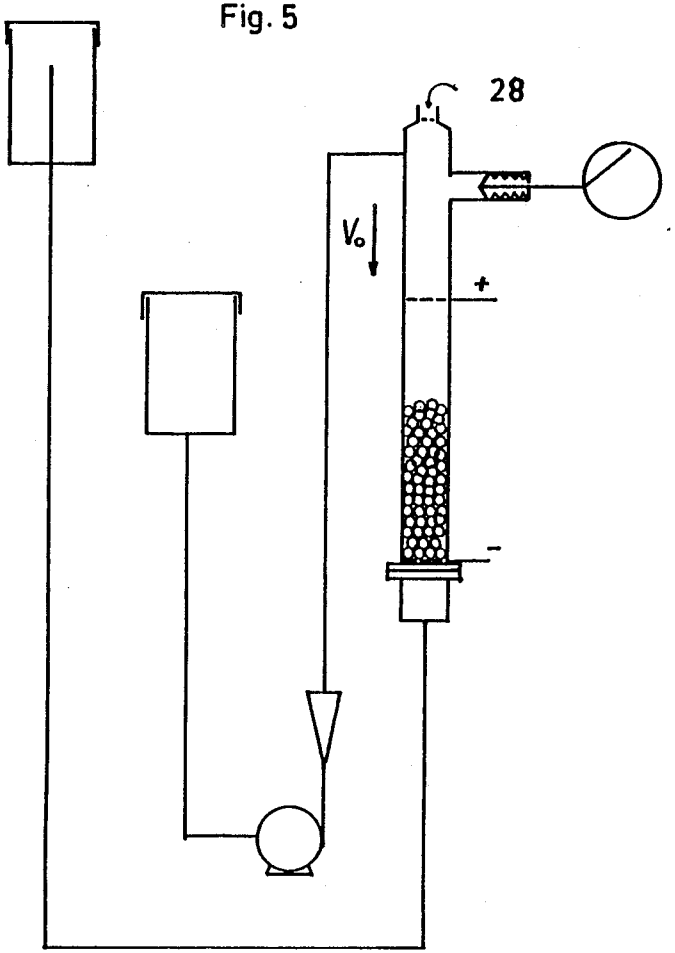

FIGS. 3 and 4 present illustrative diagrams of the operation of said installation;

FIG. 5 is a schematic view of an installation of the axial type, in which the flow velocity is downward;

FIG. 6 is a schematic view of one installation of a crossed type, with several superimposed volumic electrodes.

Figure 1:
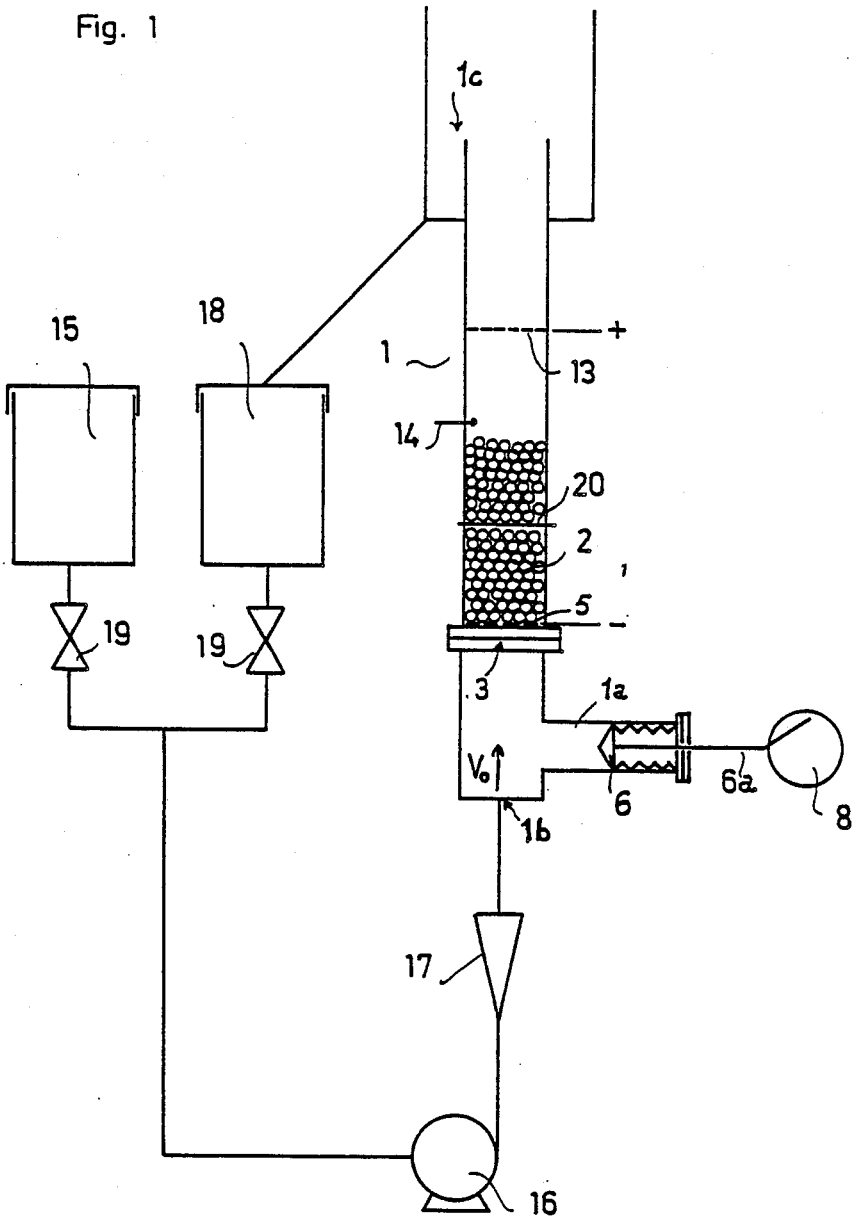
FIG. 1 is a schematic view of one installation according to the invention of the axial type, in which the flow velocity is upward.
Figure 2:
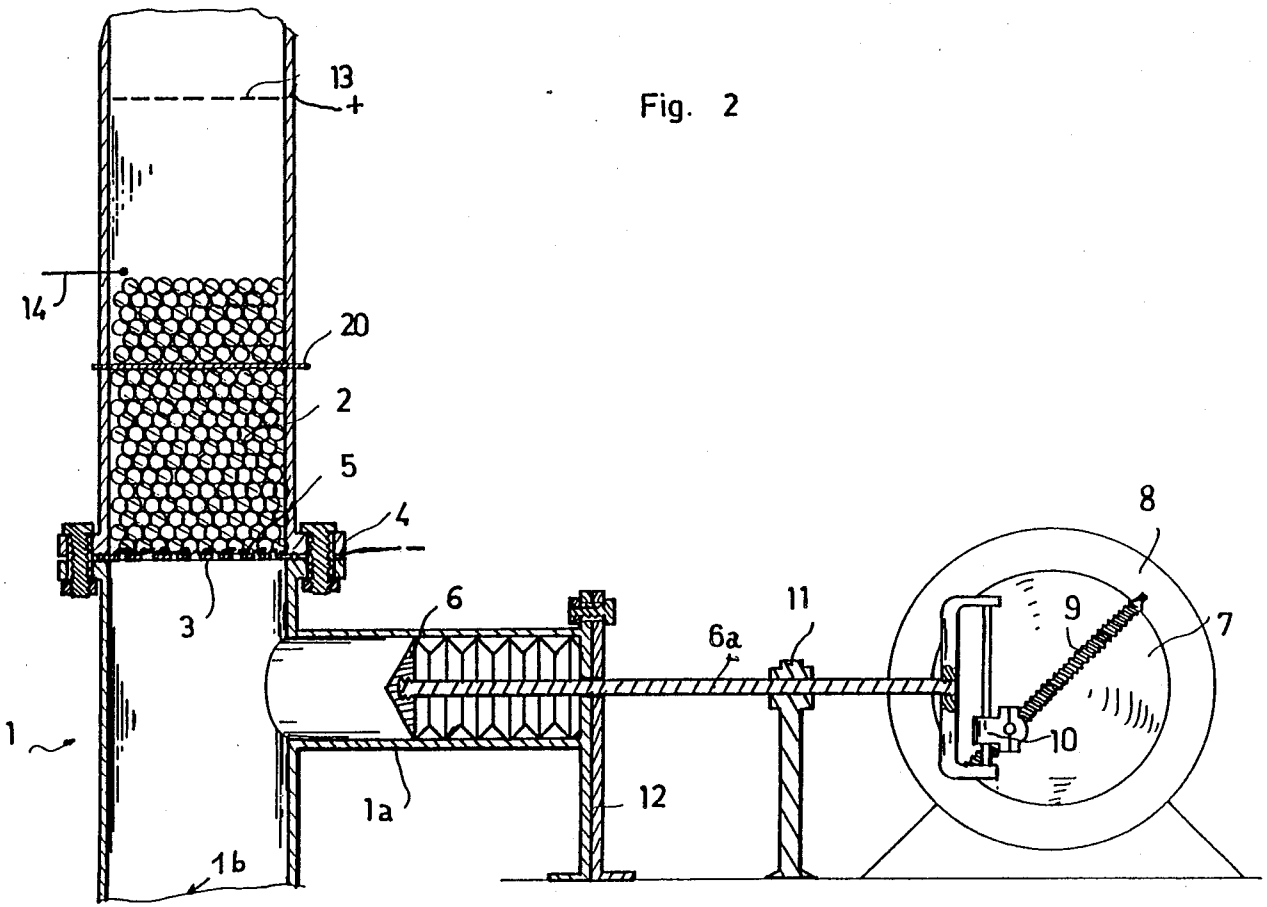
FIG. 2 is a detail view in cross section of this installation.

The installation shown by way of example in FIGS. 1 and 2 comprises a vertical axis column 1 having at its base an electrolyte inlet lb and containing a porous bed 2 of spherical conductive particles, supported by a polyethylene grill 3. This grill maintained by clamps 4 supports a current input comprising a metal spiral 5 connected to the negative terminal of an electrical generator. In the upper portion, the column is provided with a counterelectrode 13 formed by a grill of platinized titanium connected to the positive terminal of the electrical generator. This counterelectrode is positioned rather high above the bed for avoiding any contact when the bed is in the fluidized state.

Further, a reference electrode 14 ($Hg/Hg_2SO_4/K_2SO_4$: "E.S.S.") situated above the porous bed permits controlling the electrical generator in the deposited metal recovery zone.

A turbulence generator 20 comprising in the example two perpendicular insulating rods is placed in the bed in such a manner as to cause, at the time of fluidization, the placement in turbulent movement of the solid particles, favoring the homogenization of the bed.

The base of the column 1 comprises a horizontal extension 1*a* in which is mounted the means for causing the pulsation. This means comprises a displacement piston 6 formed by a deformable skirt carrying a polytetrafluoroethylene head.

The head of the piston is displaced by a rod 6*a* subjected to a back-and-forth movement. This movement is generated by an eccentric 7 actuated by a direct current, speed controlled motor 8. The amplitude -a- of movement of the piston 6 may be controlled by adjusting the eccentricity by means of a screw 9. The transformation of the rotational movement of the eccentric 7 to the translational movement is assured by a sliding bearing block 10. A support 12 (supporting the extension 1*a*) and a support standard 11 keep the rod 6*a* in a horizontal position.

The solution to be treated is withdrawn from a tank 15 by a gear pump 16 in order to be delivered at a constant upward speed Vo through a flow meter 17 at the base 1*b* of the column 1.

The treated solution leaves at the top of the column by an inclined outlet 1*c* and is recovered in a tank 18. Depending upon the application, a system of valves 19 permits treating the solution either continuously or batchwise.

The example hereinafter described is carried out in an installation such as described above.

EXAMPLE

This example relates to the recovery of copper in an electrolytic solution of 1N sulfuric acid containing 100 ppm of copper in the form of $CuSO_4$ (1.56 mole per liter).

The bed is formed of copper shot of an initial diameter of $3.7\times10^{-3}$ m (specific surface of the bed, Sp=973 $m^2/m^3$).

The amplitude -a- and the frequency -f- of the pulsation have been caused to vary respectively from $20\times10^{-3}$ to $5\times10^{-3}$ m and from 0 to 2 hertz.

The speed Vo has been fixed in this example at $10\times10^{-3}$ m/s. The minimum speed of fluidization Vmf of the copper shot used is $390\times10^{-3}$ m/s, significantly greater than these tests at Vo.

During the different tests, the intensity with respect to time I(t), the average intensity $\overline{Ip}$ and the intensity at null frequency Io have been recorded. The diagram of FIG. 3 gives the variations of $\overline{Ip}$/ Io as a function of $$\frac{2\pi a\cdot f}{Vo}$$

It is proven in the first place that the transfer is improved for $$\frac{2\pi a\cdot f}{Vo} > 4$$

On the other hand, this transfer increases progressively up to the zone of fluidization Z. The point A represents the beginning of fluidization where:

$$2\pi a.f = Vmf - Vo.$$

In this case Vmf>>Vo and, regardless of the amplitude -a- and the frequency -f- of the pulsation, the bed remains fixed during at least half of the cycle. In practice, one works in the zone Z on the plateau of the transfer curve, below the point B such that $2\pi$a.f-/Vo=1.2 Vmf/Vo. In this zone, there is obtained a very good unclogging, while having very short fractions placed in fluidization with respect to the fractions where the bed is in a fixed bed state.

FIG. 4 illustrates the instantaneous variations of speed v(t) over the course of time and causes short instants of fluidization Z to appear, and during the fraction of the cycle where the bed remains fixed, a very significant reversal or inversion of velocity. This inversion of velocity which appears beginning at ($2\pi$a.f)-/Vo>1 is the condition permitting the transfer curve (FIG. 3) to rise, the efficiency of the transfer becoming good (that is, at least equal to the efficiency in a fixed bed $\overline{Ip}$=Io) with respect to the value ($2\pi$a.f)/Vo=4.

This value of 4 is found in all of the experiments carried out and is an essential technical parameter to be taken into consideration, in order to work constantly in the zone ($2\pi$a.f)/Vo>4.

FIG. 5 shows another embodiment of the apparatus, which differs from the foregoing by:

the feed of the bed which is carried out in the upper portion in such a manner as to assure a downward percolation (Vo directed downwardly), the arrangement of means for producing the pulsation situated in the upper portion of the column, the provision of a valve 28 for assuring the evacuation of gas coming from the reaction at the counterelectrode.

If one works as before with a velocity Vo much less than the minimum fluidization velocity Vmf, the condition of placing into fluidization is written (at the term near Vo): $2\pi$a.f>Vmf. The amplitude and the frequency of the pulsation will be chosen in order to satisfy this condition; in the case where Vmf>>Vo, this condition implies that $2\pi$a.f>4 Vo; moreover, the amplitude and the frequency will be chosen in such a manner that 2 a.f<1.2 Vmf+Vo, in order that the instants of fluidization will be very short with respect to the fractions of the cycle where the bed is a fixed bed.

The installations shown in FIGS. 1, 2 and 4 are of the axial type, for which the electric field is parallel to the direction of the circulation of the electrolyte.

FIG. 6 represents another installation of the radial, multiple bed type. In this example, this installation comprises as in the first embodiment (FIGS. 1, 2) means for causing the pulsation situated at the bottom.

This embodiment differs essentially by the presence of a diaphragm 21 (porous column) arranged in the column, in such a manner as to separate the annular anodes 22 forming the counterelectrodes and the cathodes formed by the beds of the particles $C_1$, $C_2$, $C_3$, $C_4$.

The current inputs (in the example, negative) are formed by conductive grills 23, 24, 25, 26 and 27.

I claim:

1. A process for electrolysis by percolation through at least one porous volumic electrode for bringing about an electrochemical reaction, comprising electrically polarizing each volumic electrode formed of a conductive bed of solid particles (2), causing upwardly directed circulation through said volumic electrode of a liquid electrolyte with an average flow velocity Vo, and causing a pulsation of the electrolyte circulating through the volumic electrode, said process being characterized in superimposing a periodic pulsation on the circulation of the electrolyte, the pulsation having an amplitude -a- and a frequency -f- such that:

$$a\cdot f > \frac{|Vmf - Vo|}{2\pi} \text{ and } a\cdot f > 4\frac{Vo}{2\pi}$$

where Vo, a and f are the arithmetic values respectively of the flow velocity, the amplitude and the frequency, and Vmf is the arithmetic value of the minimum fluidization velocity of the bed of particles, such that:

during one fraction of the cycle, the particles of the bed forming he volumic electrode are in a lower position in a fixed bed with an instantaneous velocity resulting from the electrolyte changing direction at the center of this fraction of the cycle for giving rise to an outflow in a turbulent agitated state, and during the other fraction of the cycle termed the instant of fluidization, the particles are placed in a fluidized state.

2. A process for electrolysis as in claim 1, and wherein the velocity Vmf is great with respect to the velocity Vo, characterized in causing the pulsation in such a manner that:

$$a \cdot f \leqq \frac{1.2\ Vmf - Vo}{2\pi}$$

so that, in each cycle, the duration of the instant of fluidization is much less than the duration of the other fraction of the cycle.

3. An electrolysis process as in claim 1, characterized in causing an approximately sinusoidal pulsation.

4. An electrolysis process as in claim 1, characterized in causing pulsation of the electrolyte of which the frequency -f- is between 0.5 and 2 hertz.

5. An electrolysis process as in claim 1 and wherein said electrolyte comprises a dilute ionic solution containing metal ions.

6. A process for electrolysis by percolation through at least one porous volumic electrode for carrying out an electrochemical reaction, comprising electrically polarizing each volumic electrode formed by a conductive bed of solid particles (2), causing a liquid electrolyte to circulate in the downward direction across said volumic electrode with an average flow velocity Vo, and causing a pulsation of the circulating electrolyte through said volumic electrode, said process being characterized in superimposing a periodic pulsation on the circulation of the electrolyte having an amplitude -a- and a frequency -f- such that:

$$a \cdot f > \frac{Vmf + Vo}{2\pi} \text{ and } a \cdot f > \frac{4\ Vo}{2\pi},$$

where Vo, a and f are the arithmetic values respectively of the flow velocity, the amplitude and the frequency, and Vmf is the arithmetic value of the minimum fluidization velocity of the bed of particles, such that:

during one fraction of the cycle, the particles of the bed forming the volumic electrode are in a lower position in a fixed bed with a resulting instantaneous velocity of the electrolyte changing direction during the course of this fraction of the cycle for causing a flow in an agitated turbulent state, and during the other fraction of the cycle, termed the instant of fluidization, the particles are placed in a state of fluidization.

7. An electrolysis process as in claim 6, in which the velocity Vmf is great with respect to the velocity Vo, characterized in causing a pulsation such that:

$$a \cdot f \leqq \frac{1.2\ Vmf + Vo}{2\pi}$$

so that, in each cycle, the duration of the instant of fluidization is much less than the duration of the other fraction of the cycle.

8. An electrolysis apparatus comprising a reactor (1) having an inlet (1*b*) and an outlet (1*c*) for an electrolyte, at least one porous volumic electrode (2) formed by a conductive bed of solid particles arranged in the reactor, at least one conductive counterelectrode (13) arranged in said reactor, electric means connected to each counterelectrode and to each volumic electrode for polarizing the latter, means (16) for circulating an electrolyte in the reactor and means (6–10) for causing a pulsation of the electrolyte in the bed(s) of particles forming the volumic electrode(s), characterized in that the means for causing the pulsation comprises an extension mounted on the reactor and provided with a periodic displacement member (6) actuated by drive means (8).

9. An electrolysis apparatus as in claim 8, characterized in that the periodic displacement member (6) is connected to an eccentric (7) permitting adjustment of the amplitude -a- of its movement, the driving means being of a controlled speed type.

10. An electrolysis apparatus as in claim 8, characterized in that the bed of particles forming each volumic electrode is provided with a turbulence generator (20) adapted to cause turbulent movements in said bed during fluidization.

11. An electrolysis apparatus as in claim 8, comprising a plurality of superimposed volumic electrodes ($C_1$–$C_4$) and a plurality of counterelectrodes associated therewith.

* * * * *